US006085946A

United States Patent [19]

Hirsch et al.

[11] Patent Number: 6,085,946

[45] Date of Patent: Jul. 11, 2000

[54] SELF-SEALING COFFEE POT

[76] Inventors: Daniel J. Hirsch; Nancy Wagner, both of 527 N. Sheridan Rd., Waukegan, Ill. 60085

[21] Appl. No.: 09/320,616

[22] Filed: May 26, 1999

[51] Int. Cl.[7] ..... A47G 19/14

[52] U.S. Cl. ..... 222/475.1; 222/500

[58] Field of Search ..... 222/500, 475.1, 222/463

[56] References Cited

U.S. PATENT DOCUMENTS

| | | | |
|---|---|---|---|
| 102,124 | 4/1870 | Hobbs | 222/500 |
| 134,586 | 1/1873 | Bradley | 222/500 |
| 1,143,656 | 6/1915 | Spahr | 222/500 |
| 3,168,226 | 2/1965 | Underwood et al. | 222/500 |
| 5,137,168 | 8/1992 | Mothrath et al. | 222/500 |

*Primary Examiner*—Kevin Shaver
*Assistant Examiner*—Thach Bui
*Attorney, Agent, or Firm*—Marshall, O'Toole, Gerstein, Murray & Borun

[57] ABSTRACT

A self-sealing coffee pot is provided with a coffee container for holding liquid coffee, a pouring spout associated with the coffee container, a cover associated with the coffee container and having an opening disposed therein, a pivot member mounted to the cover and being disposed adjacent the opening, and a support mechanism that pivotably supports the pivot member. The support mechanism supports the pivot member so that the pivot member is pivotable between a closed position in which the opening in the cover is closed by a portion of the pivot member and in which substantially no vapor may escape from the interior portion of the coffee container to the atmosphere through the opening in the cover and an open position in which the opening in the cover is open and in which liquid coffee can be poured into the coffee container from a location outside of the coffee container.

23 Claims, 2 Drawing Sheets

SELF-SEALING COFFEE POT

BACKGROUND OF THE INVENTION

The present invention is directed to a self-sealing coffee pot.

Coffee is a ubiquitous beverage; it is served in homes, restaurants, and workplaces. Many devices for brewing coffee have been invented; the majority of these devices brew a batch of coffee and then store it for consumption within a short time. Some coffee brewing devices store coffee in a removable container, or coffee pot, that rests in or on a storage location within the brewing device. A coffee pot generally holds 6–10 servings of coffee; it has a handle for carrying the coffee pot without contacting hot coffee or hot parts of the coffee pot; it has an upward-opening mouth to permit the coffee brewing device to dispense brewed coffee into the pot and to permit serving coffee from the coffee pot by pouring.

One requirement of serving coffee is that it must be served hot (150–170° F.), at a temperature close to its brewing temperature. To keep the coffee in the coffee pot at the proper serving temperature, brewing devices often have electric heating elements that continuously heat the bottom of the coffee pot to maintain the coffee at an acceptable serving temperature.

This continuous heat input maintains coffee at the proper serving temperature but also has the undesirable side effect of evaporating the water used to brew the coffee. As the water evaporates, the coffee changes. The first noticeable change is a degradation of the flavor. As more water evaporates or as coffee is served from the coffee pot, the volume of coffee in the pot decreases. Most coffee brewing devices have a constant heat input to the heating elements, thus the decrease in coffee volume causes an increase in specific heat input (heat per unit volume) causing the coffee temperature to rise and increase its rate of evaporation. This increased temperature causes the coffee to develop a burned taste; at this point the coffee is no longer suitable for consumption. If the coffee pot remains on the heating element, the evaporation rate increases with the increasing temperature until the coffee evaporates completely, leaving a burnt deposit in the bottom of the coffee pot. This deposit is difficult to remove and often renders the coffee pot unusable because the sediment cannot be removed completely or leaves an undesirable odor in the coffee pot permanently.

There have been previous attempts to remedy the problem of evaporation coffee in brewing devices. U.S. Pat. No. 3,974,758 to Stone discloses a device to reduce this effect in a coffee brewing device that does not have a removable coffee pot. The Stone device does not allow for the dispensing of coffee into the coffee storage container without the removal of component 18. This represent complicates coffee brewing as the device must be removed prior to dispensing coffee into the coffee pot and re-installed after brewing is complete, a process that can take from two to ten minutes.

U.S. Pat. No. 4,482,083 to Beck discloses a coffee saver device addressing the same concerns; however, that device does not provide a substantially complete seal as there is a hole 48 in element 46 which allows a significant, continuous release of coffee vapors. Additionally, the funnel member sloping surfaces 50 have a substantial contact area with the annular flange 40. This extensive contact area is wetted by the dispensing of coffee into the device and then tends to remain wet as evaporated water from the coffee condenses on the device. These wetted components tend to adhere one to the other because of the surface tension created by the condensed coffee vapor; this makes controlling the coffee during pouring difficult, as the funnel member will adhere to the annular flange until the adhesive force holding the funnel member to the annular flange is broken by the funnel member's weight and possibly the coffee as the coffee pot is tipped. The sleeve also obscures visual observation of the funnel member 46 movement, making the serving of coffee difficult to control because of unpredictable funnel member movement. Proper sanitation of this device is also difficult because there are many wetted surfaces some of which are inaccessible for cleaning and visual observation.

A number of patents disclose liquid traps for reducing vapor release from coffee containers. For example U.S. Pat. No. 4,638,929 to Stone discloses such a device. The device presents difficulties in serving coffee as it restricts the flow of coffee during serving as the coffee must pass through a complex pathway with a small cross-sectional area. The device also does not permit pouring all of the contents of the coffee pot, as some coffee will be trapped above the divider wall 58, even if the coffee pot is inverted to the fully upside down position. This device is relatively complicated to manufacture, requiring complex, three-dimensional components that must fit very closely for the device to function properly. The device also has inaccessible wetted surfaces making proper sanitation difficult.

SUMMARY OF THE INVENTION

This invention provides a simple means of preventing or reducing undesirable evaporation of coffee from a coffee pot without interfering with the coffee brewing or serving from coffee pots. The invention does so via a small and simple device that does not interfere with the normal dispensing, storage, and serving of coffee, yet still prevents the excessive evaporation of coffee from the coffee pot by sealing the mouth of the coffee pot. This seal may be accomplished by a pivoted cap that is configured to open automatically when coffee is dispensed into the pot by an automatic brewing system. The pivoted cap also opens automatically when the coffee pot is tipped for serving coffee. Whenever the coffee pot is at rest, the cap remains in the closed position. Water vapor from the coffee within the coffee pot arises to the top of the pot, where it comes in contact with the relatively cooler, upper portions of the coffee pot. The vapor re-condenses on the upper interior surfaces of the coffee pot and then flows by force of gravity back into the coffee within the coffee pot. Should the coffee pot be exposed to conditions creating a higher-than-atmospheric pressure within the pot; the cap automatically opens momentarily to relieve the excess pressure.

The features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
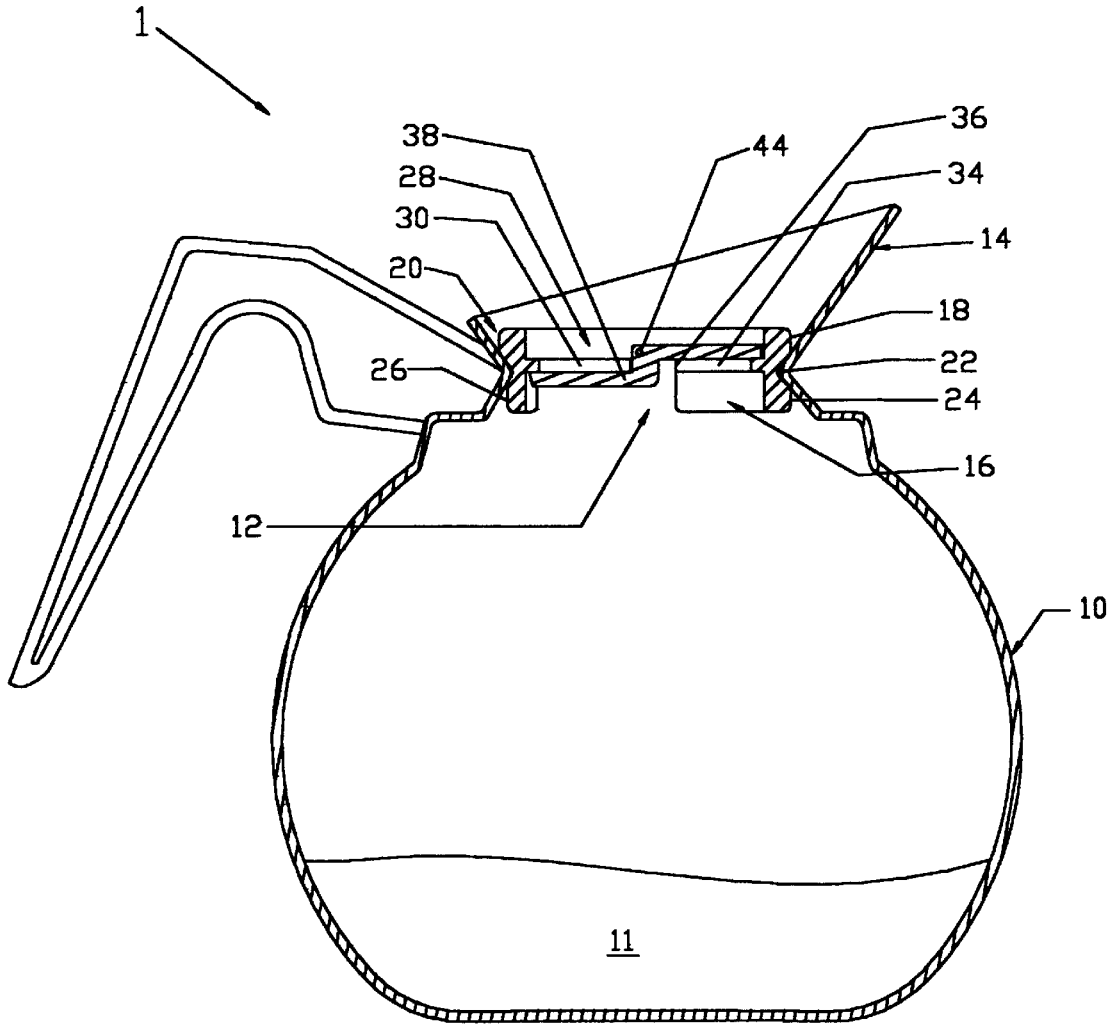
FIG. 1 is a cross-sectional side view of a preferred embodiment of a self-sealing coffee pot in accordance with the invention with a pivoting cap shown in a closed position.
Figure 2:
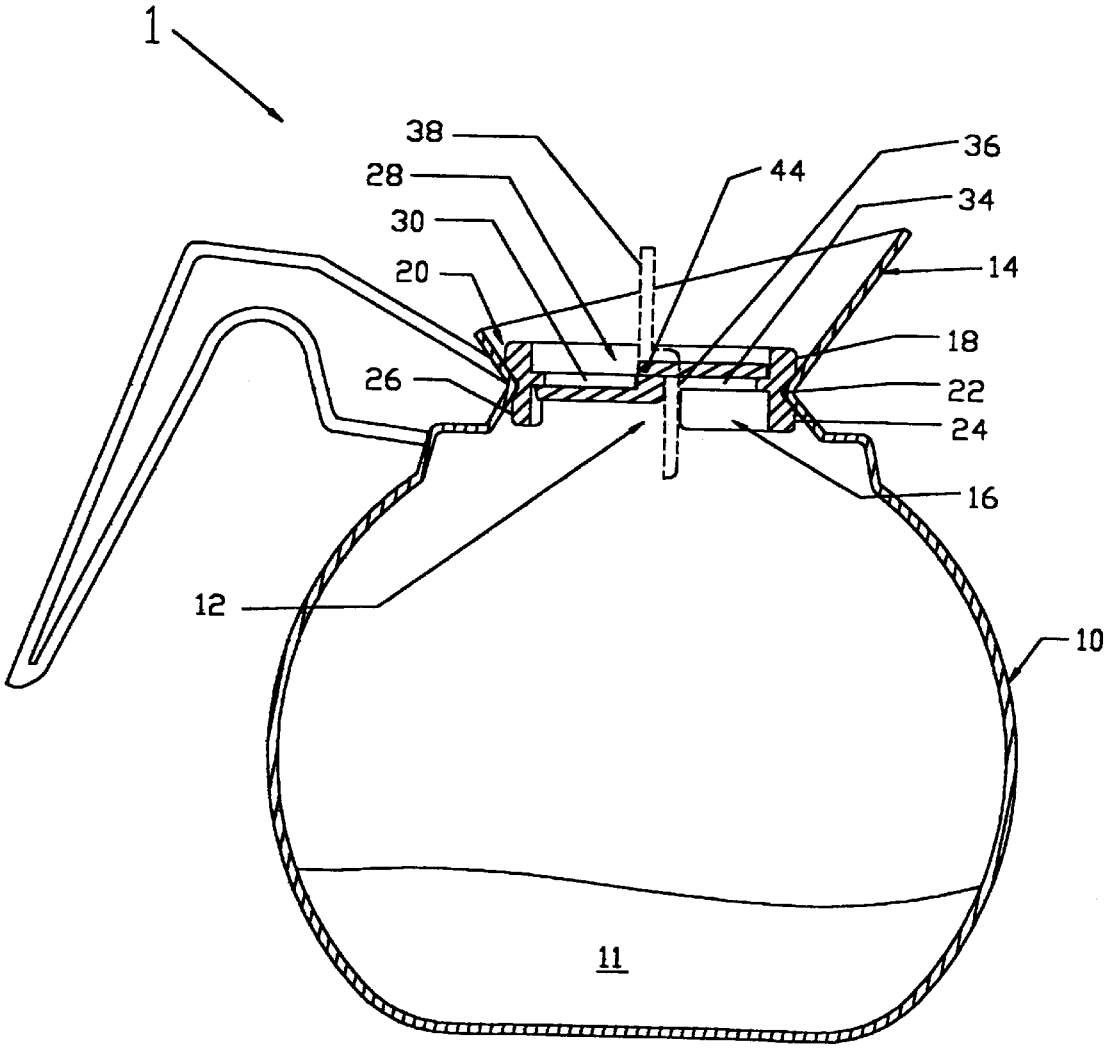
FIG. 2 is a cross-sectional side view of the coffee pot of FIG. 1 with the pivoting cap also shown in an open position.

FIGS. 1 and 2 illustrate a preferred embodiment of a self-sealing coffee pot 1. Referring to FIGS. 1 and 2, the coffee pot 1 has a coffee container 10, comprising a continuous surface enclosing a volume containing liquid coffee 11. The coffee container 10 has an upward-opening mouth 12 for the pouring of liquid coffee into and out of coffee container 10. The mouth 12 may be formed with a pouring spout 14 so that when pouring coffee from the coffee container 10 the flow of the coffee may be controlled by tipping the coffee container from the upright position to allow the coffee therein to flow through the mouth 12 and through the pouring spout 14. The mouth 12 and pouring spout 14 may be formed of a continuous piece with the coffee container 10 or may be separate pieces joined to the coffee container 10.

A toroidally-shaped cover 16 is disposed in the mouth 12. The cover 16 has a cover outer surface 18. The cover outer surface 18 shape may not be cylindrical in shape; however, the cover outer surface 18 conforms to the shape of the mouth 12 to provide a close seal between the mouth 12 and the cover 16. The cover surface 16 is disposed above, adjacent to, and below the mouth 12. The upper portion of the cover outer surface 18 disposed above the mouth 12 extends radially beyond the mouth 12 comprises a flange 20. The flange 20 has a greater outer dimension to prevent the cover 16 from passing downward through the mouth 12. Below the flange 20, the cover outer surface 18 outer diameter decreases to form a groove 22 extending the entire circumference of the cover 16. The groove 22 is disposed vertically adjacent to the narrowest portion of the mouth 12. Below the groove 22 at the front of the cover 16 adjacent to the pouring spout 14, the cover outer surface 18 increases radially to a size larger than the mouth 12, comprising a skirt 24. The skirt 24 is disposed to extend for approximately the entire front half of the mouth 12 adjacent to the pouring spout 14. The sides of the skirt 24 disposed adjacent to the sides of the mouth 12 may be cut away to permit the skirt 24 to pass through the mouth 12 as the cover 16 is placed in mouth 12 during installation in the mouth 12. Below the groove 22 at the back of the cover 16, a retention arm 26 is disposed adjacent to the back of the mouth 12 comprised of a vertically-downward extension of the cover outer surface 18 below mouth 12. The outer surface of the retention arm 26 extends radially beyond the mouth 12. The retention arm 26 is disposed to extend for some portion of the back half of the mouth 12. In its normal position, the retention arm 26 contacts the back of the mouth 12 in opposition to contact made by the skirt 24 to secure the cover 16 in place in the mouth 12. The extent and the outer diameter of the retention arm 26 may be changed to permit secure retention of the cover 16 in the mouth 12 without interfering with the ability to remove the cover 16 from the mouth 12.

The cover 16 may be provided with a generally circular opening 28 disposed in the center of the cover 16. The cover opening 28 may comprise the only passage for liquid coffee and any other liquid or gas to pass through the cover 16 and into or out of the coffee container 10. Alternatively, more than one cover opening may be provided.

The cover 16 is fitted with a semi-circular back shoulder 30 projecting radially inward from the edge of cover 16 into the cover opening 28 towards the cover opening 28 center. Back shoulder 30 extends around the interior of the cover 16 for slightly less than one half of the inner circumference of the cover opening 28 such that there are two back shoulder ends 32 to the back shoulder 30. Said back shoulder ends 32 are disposed a distance of approximately one half the thickness of the pivot member 38 from the side-to-side centerline of the cover 16 such that the back shoulder ends 32 are located within the semicircle formed by the back of the cover 16 and the cover side-to-side centerline. Back shoulder 30 is disposed away from the pouring spout 14. Back shoulder 30 top surface may be at any point below the top edge of the cover opening 28.

A semi-circular front shoulder 34 projecting radially inward from the cover 16 into the cover opening 28 may be disposed for slightly less than one half the inner circumference of the cover opening 28. Front shoulder 34 is disposed adjacent to the pouring spout 14. Front shoulder 34 top surface is disposed at the same distance below top surface of said cover opening 28 as back shoulder 30 top surface. A pair of front shoulder ends 36 may be disposed a distance of approximately the thickness of a pivot member 38 from the side-to-side centerline of the cover 16 such that the front shoulder ends 36 are located in the semicircle formed by the pouring spout 14 and the cover 16 side-to-side centerline.

The pivot member 38 may be provided in the form of a plate (such as a Z-shaped plate) disposed over the cover opening 28 so as to close the cover opening 28 to prevent the free passage of coffee and coffee vapors from the coffee container 10 when the coffee container 10 is in an upright orientation.

The front half of the pivot member 38 upper surface may have a convex shape to prevent the accumulation of liquid coffee on its upper surface during coffee dispensing. The bottom surface of said pivot member 38 front half may have a portion of its outer extremity configured to engage the cover 16 front shoulder 34 to promote the formation of a seal between the upper surface of the pivot member 38 front half. The outer extremity may be configured to prevent the pivot member 38 from adhering to the front shoulder 34 by the action of surface tension of coffee or condensed coffee on said front shoulder 34 and the pivot member 38 front half lower surface.

The back half of the pivot member 38 may feature a concave shape to collect coffee on its upper surface. In another embodiment, the back half of the pivot member 38 may be disposed below the front half of the pivot member 38, with the front half and back half being joined by a vertical extension of the pivot member 38 halves. The top surface of said pivot member 38 back half may have a portion of its outer extremity configured to engage the cover 16 back shoulder 30 to promote the formation of a seal between the upper surface of the pivot member 38 back half. The outer extremity may be configured to prevent the pivot member 38 from adhering to the back shoulder 30 by the action of surface tension of coffee or condensed coffee on said back shoulder 30 and said pivot member 38 back half upper surface. The coffee pot 1 may have a single or multiple raised contact points on the pivot member 38 contacting surfaces to reduce the adhesive forces created by the surface tension caused by the wetting of the pivot member 38 and the front shoulder 34 and the back shoulder 30. Said contact points may be disposed onto the surfaces of the front shoulder 34 and back shoulder 30.

The pivot member 38 is pivotably supported by a support mechanism 44. The pivot member 38 is free to move pivotably from a closed position to an open position. In the closed position, the pivot member 38 is disposed in the horizontal plane with the front lower surface of pivot member 38 in contact or close proximity to the upper surface of the front shoulder 34 and the back upper surface of pivot member 38 in contact or close proximity to the lower surface of back shoulder 30. In the closed position, the pivot member 38 front half contacts the front shoulder 34 and the pivot member 38 back half contacts the back shoulder 30. In the closed position, the pivot member 38 provides a physical barrier across the cover opening 28 to prevent the release of evaporated coffee vapors from the coffee container 10. In the open position, the pivot member 38 may be pivoted to a nearly vertical position. In the open position, the pivot member 38 is disposed so that the cover opening 28 is open to permit the entrance or pouring out of coffee. In the open position, the front half of the pivot member 38 is rotated upward, away from the front shoulder 34 and the rear half of the pivot member 38 is rotated downward, away from the back shoulder 30.

Figure 3:
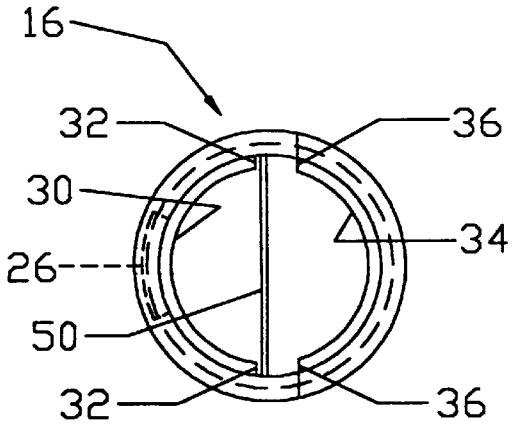
FIG. 3 is a top view of portions of the coffee pot, with other portions not shown for sake of clarity.

The support mechanism 44 is disposed at the two sides of the cover 16 so that the pivot member 38 is free to rotate about the centerline of the support mechanism 44. The support mechanism 44 may comprise a single rod element 50 (FIG. 3) disposed collinearly through the pivot member 38 and the two sides of the cover 16. The rod 50 may be free to rotate relative to the cover 16 or the pivot member 38 so that the pivot member 38 is free to move pivotably relative to the cover 16.

The support mechanism 44 may comprise two individual rod elements disposed collinearly across the two sides of the pivot member 38 such that their centerlines lie collinearly. The support mechanism 44 may comprise two rod elements projecting from the two edges of the pivot member 38. The rod elements may engage holes in the sides of the cover 16. In another embodiment, the support mechanism 44 may comprise two individual rod elements projecting radially from the sides of the cover 16 in a collinear disposition. Said rods may engage either round holes or circular fittings on the pivot member 38.

The support mechanism 44 is disposed so that the pivot member 38 may move pivotably about the side-to-side centerline of the cover 16 from the closed position 46 to the open position 48. The disposition of the support mechanism 44 may be such that the pivot member 38 center of gravity is horizontally biased towards the front of the cover 16 and the pivot point about which the pivot member 38 pivots is horizontally biased towards the back of the cover 16. This configuration will hold the pivot member 38 in the closed position 46 when the coffee pot 1 is in the upright position. The disposition of the support mechanism 44 may be such that the pivot member 38 center of gravity is vertically disposed below the pivot point about which the pivot member 38 pivots. This configuration will tend to maintain the pivot member 38 in a horizontal attitude, thereby causing the pivot member 38 to move into the open position 48 when the coffee pot is rotated from the upright position for the pouring of coffee.

The support mechanism 44 may be vertically disposed so that the pivot member 38 does not come into full contact with the front shoulder 34 and back shoulder 30 in the closed position 46. This would reduce the adhesive forces caused by the surface tension between the wetted shoulders and pivot member 38 surfaces.

OPERATION

The movement of the pivot member 38 is intended to be automatic, without the necessity of user action, with only the hydrodynamic forces of flowing coffee and the static force of gravity significantly affecting the action of the pivot member 38.

The cover 16 is intended to remain installed in the mouth 12. Installation requires first inserting the skirt 24 into the mouth 12 adjacent to the pouring spout 14, then rotating about the cover's 16 horizontal axis and pressing down on the back half of the cover 16 until the groove 22 is seated in close proximity to the narrowest portion of the mouth 12. The force acting on the retention arm 26 through the mouth 12 causes the retention arm 26 to slightly, elastically deflect inward so that the groove 22 is positioned adjacent to the mouth 12. The elastic deformation of the retention arm 26 maintains the cover 16 in close contact with the mouth 12, securing it in position.

When the coffee pot 1 is in the upright orientation, gravity holds the pivot member 38 in the closed position 46, as the pivot member 38 is supported by the support mechanism 44 and the front shoulder 34.

When coffee is dispensed into the coffee container 10, if the coffee stream does not impinge on the back half of the pivot member 38 and force it into the open position 48 by hydrodynamic force, then a slight amount of coffee accumulates on the top surface of the pivot member 38. As the back half of the pivot member 38 is either concave or lower than the font half of the pivot member 38, more coffee weight is disposed on the pivot member's 38 back half causing the member 38 to rotate into the open position. Once open, the flow of coffee will hold the pivot member 38 in the open position. When the flow of coffee stops, the force of gravity acting on the pivot member 38 will cause the pivot member 38 to return to the closed position thereby sealing the coffee container.

When the coffee pot 1 is in the upright position for heating, the pivot member 38 will be held in the closed position 46 by the gravitational forces acting on it. Should the increased temperature within the pot cause an increase in internal pressure, the pivot member 38 will open momentarily, thus avoiding any undesirable pressure buildup within the coffee container 10.

To pour coffee from the coffee pot 1, the coffee container 10 is rotated from the upright orientation, which rotation will transpose the pivot member's 38 center of gravity and the location of the support mechanism 44. When this occurs, the force of gravity will rotate the pivot member 38 into the open position 48. Should the pivot member 38 tend to close as the pot is rotated back to a more upright orientation as the individual pouring coffee reduces flow at the end of the pouring sequence, the hydrodynamic pressure of the coffee flow through the cover opening 28, out of the pouring spout 14 will tend to hold the pivot member 38 in the open position 48. When returned to the upright position, the pivot member 38 will again be moved to the closed position 46 by the forces of gravity.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A coffee pot, comprising:

a coffee container for holding liquid coffee, said coffee container having an interior portion in which said liquid coffee may be contained;

a pouring spout associated with said coffee container;

a cover associated with said coffee container, said cover having an opening disposed therein; and a pivot member mounted to said cover and being disposed adjacent said opening; and a support mechanism that pivotably supports said pivot member, said support mechanism supporting said pivot member so that said pivot member is pivotable between a closed position in which said opening in said cover is closed by a portion of said pivot member and in which substantially no vapor may escape from said interior portion of said coffee container to the atmosphere through said opening in said cover and an open position in which said opening in said cover is open and in which liquid coffee can be poured into said coffee container from a location outside of said coffee container.

2. A coffee pot as defined in claim 1 wherein said pivot member comprises a pivot plate.

3. A coffee pot as defined in claim 1 wherein said pivot member is biased to said closed position.

4. A coffee pot as defined in claim 3 wherein said pivot member has a center of gravity and wherein said pivot member is biased to said closed position by said support mechanism pivotably supporting said pivot member at a location on said pivot member offset from said center of gravity of said pivot member.

5. A coffee pot as defined in claim 1 wherein said support mechanism comprises a rod which passes through said pivot member.

6. A coffee pot as defined in claim 1 wherein said support mechanism comprises a pair of support members, each of said support members being connected to a side of said pivot member and each of said support members being attached to said cover.

7. A coffee pot as defined in claim 1 additionally comprising:

an upper shoulder member disposed adjacent said opening in said cover so that an upper side of said pivot member makes contact with a lower surface of said upper shoulder member when said pivot member is disposed in said closed position; and a lower shoulder member disposed adjacent said opening in said cover so that a lower side of said pivot member makes contact with an upper surface of said lower shoulder member when said pivot member is disposed in said closed position.

8. A coffee pot as defined in claim 1 additionally comprising a handle attached to said coffee container.

9. A coffee pot as defined in claim 1 wherein said coffee container has a circular upper lip and wherein said pour spout comprises a portion of said circular upper lip.

10. A coffee pot, comprising:

a coffee container for holding liquid coffee, said coffee container having an interior portion in which said liquid coffee may be contained, said coffee container having an opening disposed therein;

a pouring spout associated with said coffee container;

a pivot member coupled to said coffee container and being disposed adjacent said opening, said pivot member having a center of gravity;

a support mechanism that pivotably supports said pivot member, said support mechanism supporting said pivot member so that said pivot member is pivotable between a closed position in which said opening in said coffee container is closed by a portion of said pivot member and in which substantially no vapor may escape from said interior portion of said coffee container to the atmosphere through said opening in said coffee container and an open position in which said opening in said coffee container is open and in which liquid coffee can be poured into said coffee container from a location outside of said coffee container, said support mechanism biasing said pivot member to said closed position by pivotably supporting said pivot member at a location on said pivot member offset from said center of gravity of said pivot member;

an upper shoulder member disposed adjacent said opening in said coffee container so that an upper side of said pivot member makes contact with a lower surface of said upper shoulder member when said pivot member is disposed in said closed position; and a lower shoulder member disposed adjacent said opening in said coffee container so that a lower side of said pivot member makes contact with an upper surface of said lower shoulder member when said pivot member is disposed in said closed position.

11. A coffee pot as defined in claim 10 wherein said coffee container comprises a cover and wherein said opening is formed in said cover.

12. A vapor control apparatus for a coffee pot having a coffee container for holding liquid coffee and a pouring spout associated with the coffee container, said vapor control apparatus comprising:

a mounting member shaped to be mountable to a coffee container, said mounting member having an opening formed therein;

a pivot member coupled to said mounting member and being disposed adjacent said opening; and a support mechanism that pivotably supports said pivot member, said support mechanism supporting said pivot member so that, when said mounting member is mounted to a coffee container, said pivot member is pivotable between a closed position in which said opening in said mounting member is closed by a portion of said pivot member and in which substantially no vapor may escape from the coffee container through said opening in said mounting member and an open position in which said opening in said mounting member is open and in which liquid coffee can be poured into the coffee container from a location outside of the coffee container.

13. An apparatus as defined in claim 12 wherein said pivot member is biased to said closed position.

14. An apparatus as defined in claim 12 wherein said pivot member has a center of gravity and wherein said pivot member is biased to said closed position by said support mechanism pivotably supporting said pivot member at a location on said pivot member offset from said center of gravity of said pivot member.

15. An apparatus as defined in claim 12 additionally comprising:

an upper shoulder member disposed adjacent said opening in said mounting member so that an upper side of said pivot member makes contact with a lower surface of said upper shoulder member when said pivot member is disposed in said closed position; and a lower shoulder member disposed adjacent said opening in said mounting member so that a lower side of said pivot member makes contact with an upper surface of said lower shoulder member when said pivot member is disposed in said closed position.

16. A coffee pot, comprising:

a coffee container for holding liquid coffee, said coffee container having an interior portion in which said liquid coffee may be contained, said coffee container having an opening associated therewith, and said coffee container having an upper rim;

a pivot member operatively coupled to said coffee container, said pivot member being disposed adjacent said opening associated with said coffee container;

a support mechanism that pivotably supports said pivot member, said support mechanism supporting said pivot member so that said pivot member is pivotable between a closed position in which said opening is closed by a portion of said pivot member and in which substantially no vapor may escape from said interior portion of said coffee container to the atmosphere through said opening and an open position in which said opening is open and in which liquid coffee can be dispensed into said coffee container from a location outside of said coffee container, said pivot member being biased to said closed position, said pivot member being disposed at a point below said upper rim of said coffee container so that coffee may accumulate on top of said pivot member up to said upper rim of said coffee container when said pivot member is in said closed position, said pivot member being shaped so that when coffee is present on top of said pivot member when said pivot member is in said closed position, the weight of the coffee on top of said pivot member will cause said pivot member to pivot to said open position in which the coffee will pass through said opening and into said coffee container.

17. A coffee pot as defined in claim 16 wherein said pivot member has a first upper surface disposed at a first elevation and a second upper surface disposed at a second elevation different than said first elevation.

18. A coffee pot as defined in claim 16 wherein said pivot member has a first upper surface disposed at a first elevation and a second upper surface disposed at a second elevation different than said first elevation and wherein said first upper surface is disposed adjacent a pouring spout and wherein said second upper surface is disposed opposite said pouring spout.

19. A coffee pot as defined in claim 16 wherein said pivot member has a center of gravity and wherein said pivot member is biased to said closed position by said support mechanism pivotably supporting said pivot member at a location on said pivot member offset from said center of gravity of said pivot member.

20. A vapor control apparatus for a coffee pot having a coffee container for holding liquid coffee and an upper rim, said vapor control apparatus comprising:

a pivot member;

a mounting member that pivotally supports said pivot member, said mounting member being shaped to be mounted to the coffee container below the upper rim of the coffee container to allow coffee to accumulate on top of said pivot member up to the upper rim of the coffee container, said mounting member having an opening formed therein; and a support mechanism that pivotably supports said pivot member, said support mechanism supporting said pivot member so that, when said mounting member is mounted to the coffee container, said pivot member is pivotable between a closed position in which said opening in said mounting member is closed by a portion of said pivot member and in which substantially no vapor may escape from the coffee container through said opening in said mounting member and an open position in which said opening in said mounting member is open and in which liquid coffee can be dispensed into the coffee container from a location outside of the coffee container, said pivot member being biased to said closed position, said pivot member being shaped so that when coffee is present on top of said pivot member when said pivot member is in said closed position, the weight of the coffee which accumulates on top of said pivot member when said mounting member is mounted to the coffee container will cause said pivot member to pivot to said open position in which the coffee will pass through said opening in said mounting member and into the coffee container.

21. A coffee pot as defined in claim 20 wherein said pivot member has a first upper surface disposed at a first elevation and a second upper surface disposed at a second elevation different than said first elevation.

22. A coffee pot as defined in claim 20 wherein said pivot member has a first upper surface disposed at a first elevation and a second upper surface disposed at a second elevation different than said first elevation and wherein said first upper surface is disposed adjacent a pouring spout and wherein said second upper surface is disposed opposite said pouring spout.

23. A coffee pot as defined in claim 20 wherein said pivot member has a center of gravity and wherein said pivot member is biased to said closed position by said support mechanism pivotably supporting said pivot member at a location on said pivot member offset from said center of gravity of said pivot member.

* * * * *